United States Patent [19]

Jensen et al.

[11] Patent Number: 4,667,600

[45] Date of Patent: May 26, 1987

[54] SAFE/ARM EXPLOSIVE TRANSFER MECHANISM

[75] Inventors: Norman E. Jensen, Plymouth; Bennett W. Kelley, Chanhassen, both of Minn.

[73] Assignee: The United States of America as represented by the Secretary of the Air Force, Washington, D.C.

[21] Appl. No.: 833,640

[22] Filed: Feb. 25, 1986

[51] Int. Cl.[4] ..... F42B 15/02; F42C 15/12

[52] U.S. Cl. ..... 102/254; 102/339; 102/387

[58] Field of Search ..... 102/386, 387, 396, 397, 102/425, 337, 339, 340, 348, 354; 89/1.51, 1.55

[56] References Cited

U.S. PATENT DOCUMENTS

| | | | |
|---|---|---|---|
| 2,198,697 | 4/1940 | Driggs | 102/254 X |
| 2,913,984 | 11/1959 | Meek et al. | 102/247 |
| 3,055,300 | 9/1962 | Stoehr | 102/339 |
| 3,351,017 | 11/1967 | Myers | 102/337 |
| 3,382,803 | 5/1968 | Swallow et al. | 102/387 X |
| 3,425,353 | 2/1969 | Halling | 102/255 |
| 3,515,067 | 6/1970 | Min | 102/397 |
| 3,515,071 | 6/1970 | Brackman | 102/396 X |
| 3,625,106 | 12/1971 | Russo et al. | 102/387 X |
| 3,633,507 | 1/1972 | Morley et al. | 102/387 |
| 3,877,378 | 4/1975 | Clark et al. | 102/270 X |
| 4,029,014 | 6/1977 | Cunningham | 102/337 |
| 4,367,680 | 1/1983 | Hart | 102/387 |

*Primary Examiner*—David H. Brown

*Attorney, Agent, or Firm*—Richard J. Donahue; Donald J. Singer

[57] ABSTRACT

A safe/arm mechanism for an air-delivered explosive device uses a slider containing explosive leads as the means of interrupting the explosive train. The slider is locked in the safe position such that the explosive leads are out-of-line with respect to the detonator. The slider is attached directly to the main parachute such that when two locks are removed the parachute deployment forces can overcome a shear pin lock and move the slider to an in-line or armed position where it is positively retained. In this position, initiation of the detonator will allow the explosive output of the detonator to be transferred to its associated explosive device and provide a dual point radial initiation of its booster charge.

5 Claims, 9 Drawing Figures

SAFE/ARM EXPLOSIVE TRANSFER MECHANISM

STATEMENT OF GOVERNMENT INTEREST

The invention described herein may be manufactured and used by or for the Government for governmental purposes without the payment of any royalty thereon.

BACKGROUND OF THE INVENTION

The present invention concerns an improved safety and arming mechanism for an air-delivered explosive device.

In explosive missiles such as bombs, rockets, projectiles and the like, which deliver a warhead to a distant object, it has been found that a reliable way of providing safety is to keep one portion of the explosive detonation train to the warhead out-of-line until after the missile is launched. At a predetermined time after launching, the explosive train is caused to be aligned and the missile is said to be armed. A device which accomplishes the above is known as a safety and arming device, or safe/arm mechanism.

The out-of-line feature mentioned above has become a basic characteristic of practically all safe/arm mechanisms. One such mechanism, for example, includes an interrupter rotor which aligns a detonator with an explosive firing train at some time after launching. Several latches, located on the rotor and on the rotor actuating means, are used to prevent the rotor from being rotated until after launching.

Some safe/arm mechanisms are specifically adapted for use with parachute-delivered explosive devices. One such mechanism, which is used with a warhead ejected into an impinging airstream, includes a malleable safety washer which is crushed as a consequence of imposed shock resulting from the deployment of an attached delivery parachute. Most safe/arm mechanisms which utilize parachute pull to provide arming energy also use an interface mechanism of some kind as a buffer, thus adding to the complexity and adversely affecting the reliability of the mechanism.

To date, safe/arm mechanisms for air-delivered explosive devices have not fully satisfied existing needs, as such mechanisms generally utilize complex and expensive actuating means, are usually difficult to assemble, are often unsafe to handle and store, and lack the high degree of reliability and safety commensurate with modern explosive weapons.

OBJECTS AND SUMMARY OF THE INVENTION

Accordingly, it is the primary object of the present invention to provide an air-arming safe/arm mechanism having reliable means for maintaining a positive safe condition and a reliable firing operative function.

Another object is to provide a safe-arm explosive transfer mechanism which may be readily ejected from airborne aircraft, and subsequently armed by an airstream impinging on a deployed parachute attached to the mechanism.

A further object is to provide a safe/arm mechanism of the character described above having a retaining means for positively maintaining the mechanism in a safe condition prior to installation in a dispenser.

Still another object is to provide a simple, economic, and safe-to-handle, air delivered safe/arm mechanism which is capable of deploying a delivery parachute with a high degree of reliability, and arming as a consequence of such parachute deployment.

Yet another object is to provide a safe-arm mechanism having means for tailoring the warhead explosive propagation pattern.

The foregoing objects are accomplished in the safe/arm mechanism of the present invention which uses a slider having a tubular channel therein containing explosive material, and forming an explosive lead, as the means of interrupting the explosive train. The slider is locked in a safe position such that the explosive lead is out-of-line with respect to the detonator and the warhead. The slider is attached directly to a main parachute such that when two locks are removed, the parachute deployment forces will overcome a shear pin lock and move the slider to an in-line or armed position where it is retained by an additional lock. In this position, initiation of the detonator will allow the explosive output of the detonator to be transferred to the warhead and permit a dual point radial initiation of the firing of the warhead.

Additional objects, advantages and features of the invention will become apparent as the following detailed description thereof is read in conjunction with the accompanying drawings, wherein like elements are given the same reference numerals throughout.

DETAILED DESCRIPTION OF THE INVENTION

Figure 1:
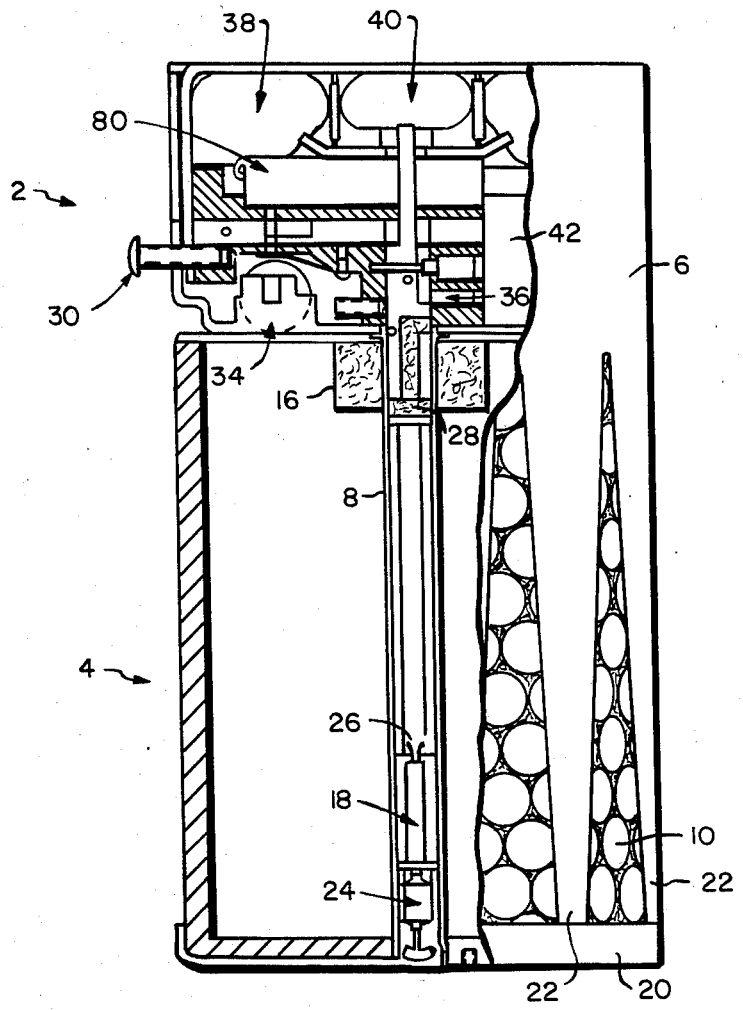
FIG. 1 is a partially cutaway side view of the safe/arm mechanism of the present invention as integrated with an explosive warhead device.

The safe/arm explosive transfer mechanism 2 of the present invention, is shown in FIG. 1 as it is integrated with an explosive munition or warhead 4 via an outer casing 6. Portions of the outer casing 6 have been removed in the drawing in order to expose various parts of the warhead 4 and safe/arm mechanism 2.

Warhead 4 may take various forms but is shown herein to have a generally cylindrical shape with an axial tube 8 and a scored (to be readily fragmentable) sleeve 10. The main explosive charge which fills the space therebetween is ignited by a booster charge 16.

Warhead 4 is intended to be deployed on enemy terrain to be detonated upon the sensing of noise generated by an approaching target. Therefore, upon landing at its destination, a piston actuator 18 within a tube 10 is activated to push on end cap 20 and thereby release the spring finger ends 22 of outer casing 6. This causes the warhead 4 to be urged into a position whereby a microphonic sensor 24 is exposed and substantially upright to detect sounds from approaching targets. Upon sensing a target, sensor 24 provides a signal on its leads 26 to a detonator which initiates the explosion of warhead 4 via the explosive train lead 28 which protrudes therein from safe/arm mechanism 2.

The presence of tube 8 through the center of the warhead 4 precludes a central planar initiation of the booster charge 16. However, the present invention utilizes a T-shaped explosive lead 28 that converts a single point planar explosive output to a dual point planar initiation of the booster charge 16. By so doing, the penalty of variable fragment velocities associated with a single, off-center planar intiation of a warhead is avoided.

Various parts of the safe/arm mechanism 2 which are visible in FIG. 1 include a safety screw 30, which is removed after the munition is loaded into its dispenser, cable cutter 32, battery 34, detonator 36, decelerator (main parachute) 38, and stabilizer (drogue parachute) 40. The electronics/timing device required to process signals from microphonic sensor 24 and provide signals at specified times during the operation of the mechanism is of conventional design and is contained in the area 42 of the safe/arm mechanism.

Figure 2:
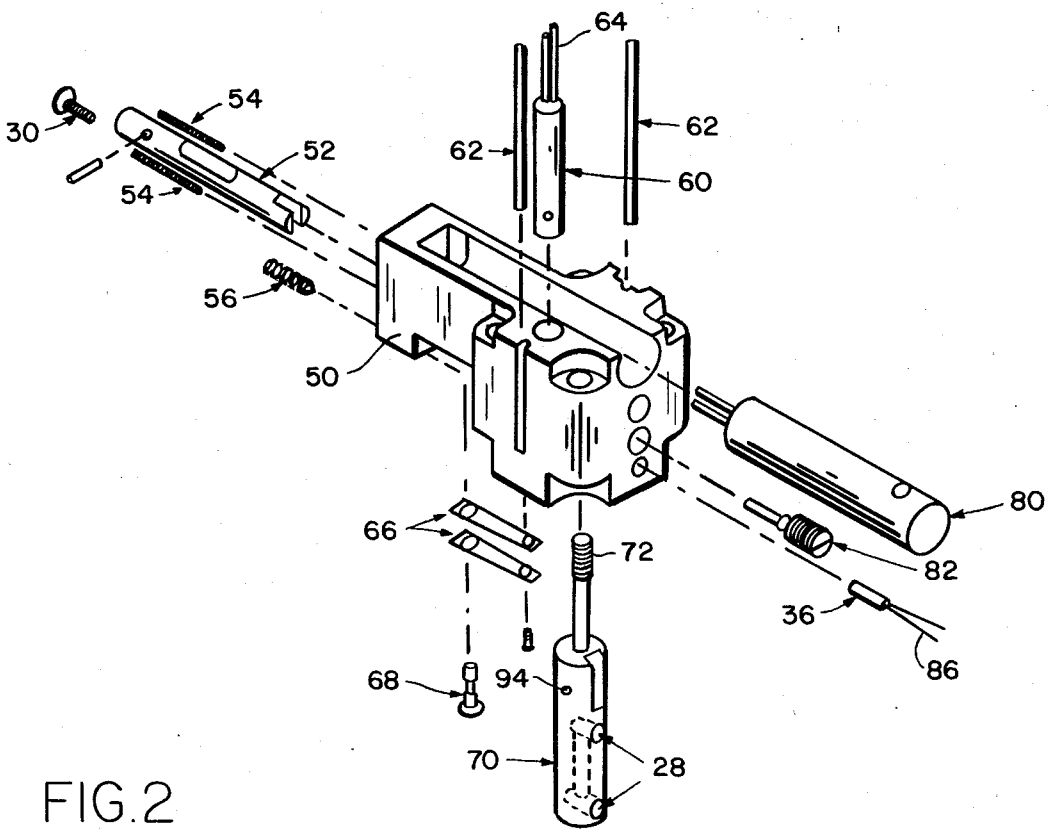
FIG. 2 is an expanded perspective view of the safe/arm mechanism of the present invention.

The expanded view of FIG. 2 reveals the housing 50 of the safe/arm mechanism and its associated safety screw 30, borerider pin 52, borerider springs 54, detent assembly 56, cable cutter 60, stabilizer retaining cable 62, electrical lead wires 64, spring and guide members 66, firing pin 68 and slider 70. Slider 70 will be seen to have a T-shaped passage therein containing a chain of explosive material forming an explosive lead 28. The function of the T-shape at the bottom of lead 28 concerns the desired dual-point initiation of the warhead mentioned earlier. Also associated with housing 50 are a cable cutter 80, shear pin/key 82 and detonator 36 having lead wires 86.

Slider 70, which contains the explosive lead 28 and interrupts the explosive train is locked in the safe position such that the explosive lead 28 is out-of-line with respect to the detonator. Slider 70 is attached directly to a main parachute via its threaded end 72 such that when a first two locks are removed, the parachute deployment forces will overcome the shear pin 82 (which constitutes a third lock) and move the slider to an in-line or armed position where it is retained by a detent pin. In this position, initiation of the detonator 36 will allow its explosive output to be transferred to lead 28 and establish a dual point radial initiation of the booster charge 16.

Figure 3:
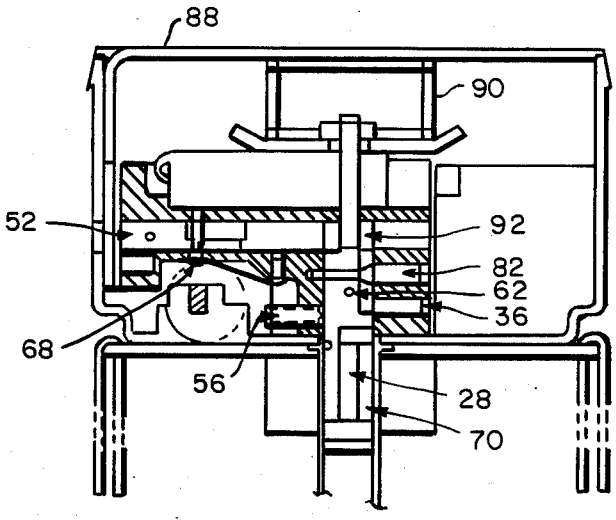
FIGS. 3–7 are sectional side views of the present invention illustrating the positions of its various component parts during sequential steps in the operation of the invention.

The various steps in the deployment and arming sequence are illustrated in FIGS. 3–7. FIG. 3 shows the full safe position and shows the positions of three locks on the slider, i.e., the borerider pin 52, stabilizer retaining cable 62 and shear pin 82. Also noted in the drawing are firing pin 68, detent pin assembly 56, detonator 36, and slider 70 with its explosive lead 28. The dispenser cover 88 of the safe/arm assembly 2 is spring loaded thereto by the action of spring 90.

Figure 4:
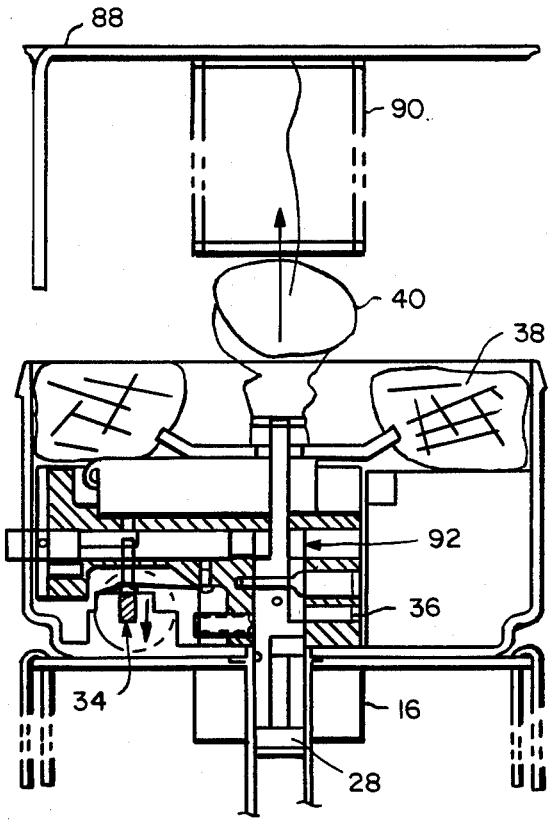

FIG. 4 shows the condition of safe/arm mechanism 2 after its ejection from the dispenser 88 with the motion of the spring-loaded borerider pin 52 causing the firing pin 68 to be released (resulting in the battery 34 being initiated) and the first lock 52 to be removed from the slider 70. Stabilizer 40 is deployed at this time.

Figure 5:
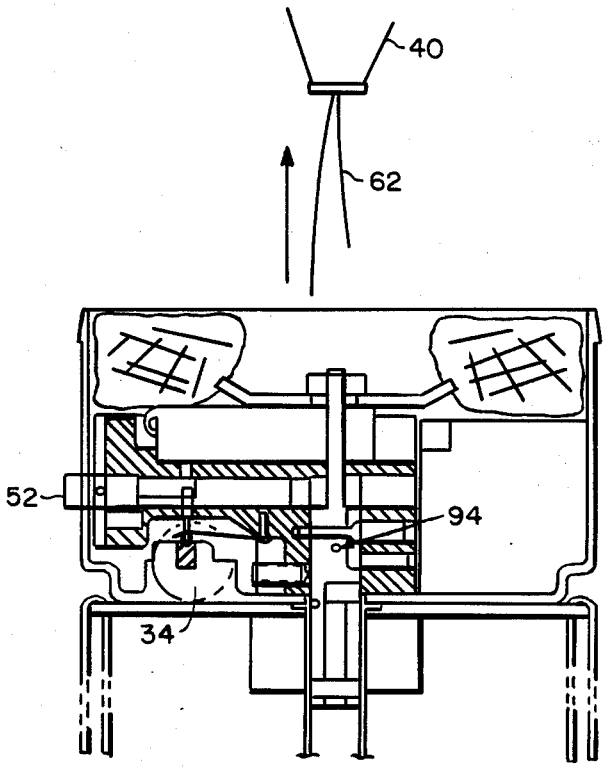

FIG. 5 shows the second lock removed by cutting the stabilizer retaining cable 62 with an electro-explosive cable cutter 60. The use of the stabilizer retaining cable 62 to provide a lock on slider 70 is unique and provides a great deal of safety, essentially without additional cost or reliability degradation. Stabilizer retention and removal is required in any event and the cable is simply threaded through the slider 70 via hole 94.

Figure 6:
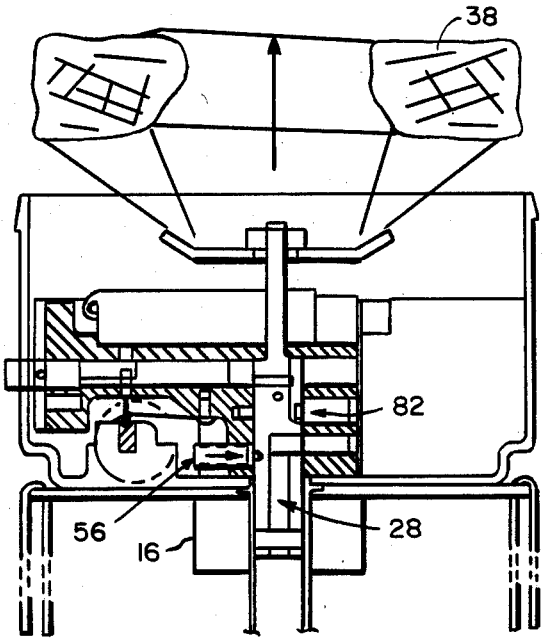

FIG. 6 shows the slider in-line and locked as a result of the decelerator 38 (main parachute) being deployed and the shearing of shear pin 82. Detent pin 56 engages slider 70 and locks it in place. Explosive lead 28 is now in-line between detonator 36 and booster charge 16 of warhead 4.

Figure 7:
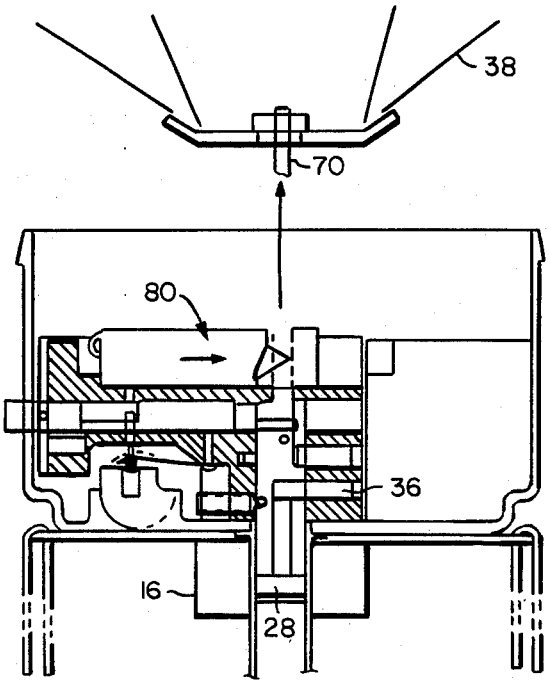

FIG. 7 shows the condition at impact of the warhead with the ground where the large electro-explosive cable cutter 80 has been initiated via an impact switch (within the electronics/timer module) causing the decelerator parachute 38 to be separated and a hard-wired short across the detonator 36 to be removed. A fire-pulse to the detonator 36 from microphonic sensor 24 will now result in the detonation of the warhead.

Figure 8A:
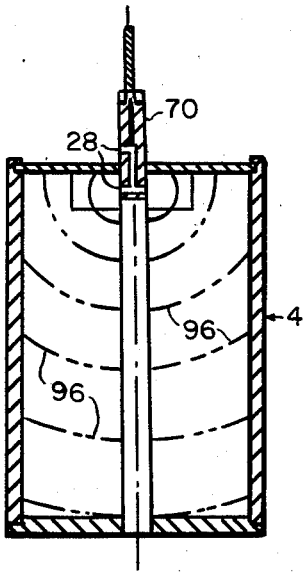
FIGS. 8A and 8B are sectioned side and end views respectively of the warhead illustrating the explosive shock wave pattern formed by the dual point radial initiation of the warhead by the safe/arm mechanism of the present invention.
Figure 8B:
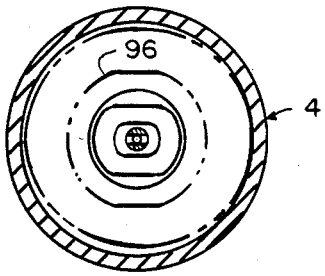

FIGS. 8A and 8B illustrate the dual point planar initiation pattern 96 accomplished by the T-shaped explosive lead 28 within slider 70.

While the present invention has been described in connection with a rather specific embodiment thereof, it will be understood that many modifications and variations will be readily apparent to those of ordinary skill in the art and that this patent is intended to cover any adaptation or variation thereof. Therefore, it is manifestly intended that this invention be only limited by the claims and the equivalents thereof.

What is claimed is:

1. A safe/arm mechanism for use with an explosive device of the type released from a dispenser on an aircraft and having a stabilizing drogue and a main parachute, said mechanism comprising:

a housing;

a detonator in said housing;

a slider in said housing having an end thereof attachable to a parachute and having an explosive lead therein;

said slider having a safe position wherein said explosive lead is out-of-line with said detonator, and having an armed position wherein said explosive lead is in-line with said detonator to complete an explosive train between said detonator and an explosive device attached to said mechanism; and first, second and third locking means for maintaining said slider in said safe position;

said first locking means comprising a spring-loaded pin having an end thereof engaging said slider to prohibit movement of said slider to said armed position until release of said mechanism from a dispenser;

said second locking means comprising a retaining cable for a stabilizing drogue threaded through said housing and said slider to prohibit movement of said slider to said armed position until said cable is severed upon release of said stabilizing drogue;

said third locking means comprising a shear pin positioned in said housing and through said slider to prohibit movement of said slider to said armed position until said shear pin is severed by deployment of said parachute.

2. A safe/arm mechanism as defined in claim 1 wherein said slider is a cylindrical rod and wherein said explosive lead is a cavity in said slider filled with explosive material and having a pair of diametrically-opposed radial arms extending through said rod to contact said explosive device.

3. A safe/arm mechanism as defined in claim 2 and having a fourth locking means for maintaining said slider in said armed position after release of said first, second and third locking means.

4. A safe/arm mechanism as defined in claim 3 wherein said fourth locking means comprises a detent pin in said housing and a detent in said slider.

5. A safe/arm mechanism as defined in claim 4 and further comprising a safety screw in said housing engaging said spring-loaded pin to prevent movement of said pin prior to installation of said mechanism in said dispenser.

* * * * *